US006145993A

United States Patent [19]

Filippino

[11] Patent Number: 6,145,993

[45] Date of Patent: Nov. 14, 2000

[54] ILLUMINATED CANE TIP

[76] Inventor: Frank Filippino, 2886 Victory Blvd., Staten Island, N.Y. 10314

[21] Appl. No.: 09/359,143

[22] Filed: Jul. 21, 1999

[51] Int. Cl.[7] ..... A45B 3/04

[52] U.S. Cl. ..... 362/102; 362/109

[58] Field of Search ..... 362/109, 118, 362/119, 120, 102, 202–205

[56] References Cited

U.S. PATENT DOCUMENTS

| | | | |
|---|---|---|---|
| 2,271,190 | 1/1942 | Giaimo | 362/102 |
| 2,642,519 | 6/1953 | Caustin . | |
| 3,987,807 | 10/1976 | Varnell . | |
| 4,099,535 | 7/1978 | Hubachek . | |
| 4,226,163 | 10/1980 | Welcomer | 384/422.4 |
| 4,562,850 | 1/1986 | Earley et al. . | |
| 4,625,742 | 12/1986 | Phillips . | |
| 5,197,501 | 3/1993 | Ragatz . | |
| 5,331,990 | 7/1994 | Hall et al. . | |
| 5,351,704 | 10/1994 | Hunnicutt, Jr. et al. . | |
| 5,577,827 | 11/1996 | Leffingwell et al. . | |

*Primary Examiner*—Sandra O'Shea
*Assistant Examiner*—Ismael Negron
*Attorney, Agent, or Firm*—Mary A. Whiting, Reg. Patent Attorney

[57] ABSTRACT

An illuminated cane tip, which communicates the sight handicapped user's needs to others. It's illumination may be of varying colors, and can be used both day and night. It is made of a hard transparent or translucent acrylic material for maximum strength. Flakes of reflective material or air bubbles may be added to enhance its light emitting effect. A battery, light bulb, switch and conducting wires, are housed within the invention. The invention may be formed from a solid mold, or may be hollow. The invention is attached to a cane by either knot or slide means. When attached by knot means, the cane's cord is threaded through a needle eye opening in the invention; pulled through the cane's shaft, looped through the handle of the cane, again pulled through the cane's shaft, and knotted in order to secure the invention to the cane. When attached by slide means, the hollow neck portion of the invention, slides over the cane. If the cane is hollow, the cane's cord is threaded through a conventional stopper, by the same method deployed above.

3 Claims, 3 Drawing Sheets

ILLUMINATED CANE TIP

BACKGROUND

1. Field of the Invention

The present invention relates to a transparent or translucent cane tip device for emitting light, to be used by sight handicapped persons, in order to communicate the user's needs to others, at low cost, with ease of disposing and interchanging the device onto various canes.

2. Description of the Prior Art

Prior art devices disclose many canes, batons, and flashlights whereby batteries, lights, switches, and conducting wires are incorporated into the shaft of the device. These prior art devices either aid persons in seeing better, or were used as a beacon to designate the user's position to others. The switch was located distant from the batteries and light source in these prior art devices. That is, the switch was usually in the handle of the cane, and the light source was in the shaft. Also, the battery, light, and switch were built into the cane. Therefore, the user had to purchase the entire cane in order to obtain a lighted cane. These prior art devices were also clumsy, heavy and were neither interchangeable nor readily disposal. Since these prior art devices were incorporated into conventional canes, the ground tip was a conventional opaque rubber tip, and no light emitted from it. The present invention can be differentiated from these prior art devices since the present invention is a transparent or translucent integrated unit, where the light, batteries and switch are house in a compact integrated, interchangeable, and disposal unit. The present invention emits light in all directions, rather than only from a specific location on the cane.

There are several patents which disclose various lighted cane devices:

| Inventor | Patent Number | Date |
|---|---|---|
| Leffingwell et. al. | Pat. No. : 5,577,827 | November 26, 1996 |
| Hall et. al. | Pat. No. : 5,331,990 | July 26, 1994 |
| Hunnicutt, Jr. et. al. | Pat. No. : 5,351,704 | October 4, 1994 |
| Ragatz | Pat. No. : 5,197,501 | March 30, 1993 |
| Earley et. al. | Pat. No. : 4,562,850 | January 7, 1986, |
| Phillips | Pat. No. : 4,625,742 | December 2, 1986, |
| Hubachek | Pat. No. : 4,099,535 | July 11, 1978 |
| Varnell | Pat. No. : 3,987,807 | October 26, 1976 |
| Caustin | Pat. No. : 2,642,519 | June 27, 1949 |
| Giaimo | Pat. No. : 2,271,190 | June 8, 1940 |

Leffingwell et. al., U.S. Pat. No. 5,577,827 dated Nov. 26, 1996 is cane device with an alarm and a lighted end. Since the present invention's lighted translucent or transparent body is one integrated unit, which emits light, it can be distinguished from Leffingwell's opaque resin ground tip, which does not emit light.

Hall et. al., U.S. Pat. No. 5,331,990 dated Jul. 26, 1994, is a safety cane device, which is also connected to a telephone alarm system. A lighted window in the cane's shaft aids the user's sight. Since the present invention's lighted body is one integrated unit, which emanates light in all directions, it is distinguished from Hall's invention which optimizes a light pattern for right handed or left handed users. Since the user of the present invention is sight-handicapped, it's purpose is to communicate the user's needs to others, rather than aid the user's sight.

Hunnicutt, Jr. et.al., U.S. Pat. No. 5,351,704 dated Oct. 4, 1994, provides for a lighted walking cane, with a body and ground tip composed of a clear rubber material with reflecting means to supply light in a specific direction. Illuminating means and the circuit are housed in different portions of the cane. The present invention is differentiated from Hunnicutt's invention since it is a clear integrated unit which emits light in all directions.

Ragatz, U.S. Pat. No. 5,197,501 dated Mar. 30, 1993, is a lighted cane housing two light sources and an alarm. The switch and battery are housed separately from the light units. The light in the conventional opaque ground tip portion of Ragatz's invention is positioned to direct reflected light longitudinally along the shaft. Since the present invention's lighted body is one integrated unit, which emits light in all directions, it is distinguished from Ragatz's invention, which has an opaque tip and directs light in a specific direction.

Earley et. al., U.S. Pat. No. 4,562,850, dated Jan. 7, 1986, houses the switch in the handle, while the illumination device is near the base of the cane. The present invention is differentiated from Earley's invention since its light is cast twelve to fifteen inches from the user, while in the present invention, the device will emit an overall glow. In addition, the present invention can be distinguished from Earley's invention, since the present invention's lighted body is one integrated unit.

Phillips, U.S. Pat. No. 4,625,742 dated Dec. 2, 1986, is a cane that is used for lighting the user's walkway as well as a beacon for others to see the user. The light emitting end portion (ground tip) is translucent or transparent. The light source and battery are housed separately from the switch. Since the present invention's lighted body is one integrated unit, it is distinguished from Phillip's invention since it is housed inside a cane and is intended to aid the user's sight. The present invention is an integrated unit, and is meant for blind users.

Hubachek, U.S. Pat. No. 4,099,535, dated Jul. 11, 1978, is for a walking cane for the blind; visible day or night, with portion of the cane shaft above the ground tip having a window for the emission of light. The wear tip or ground engaging member is made of a conventional, opaque material. The switch is in the handle. The present invention can be distinguished from Hubachek's invention, since the present invention's lighted body is one integrated unit, and its light does not emanate from a specific window but rather, is emitted in all directions.

Varnell, U.S. Pat. No. 3,987,807, dated Oct. 26, 1976, has a light at the end of the tip of the cane, operated by a switch in the handle. Its purpose is to allow the user to see in dark comers and around areas, which is different from the present invention which communicates the user's needs to others. Additionally, the present invention can be differentiated from the Varnell invention since the present invention's lighted body is one integrated unit.

Caustin, U.S. Pat. No. 2,642,519, dated Jun. 27, 1949, allows for motorists and drivers of vehicles to be able to see and recognize the user's affliction. The light travels through the shaft length. The ground tip is made from a material that obstructs the light from the end of the shaft. Although similar in general purpose, the present invention can be differentiated from Caustin's invention, since the present invention's lighted translucent or transparent body is one integrated unit. More specifically, the colors of the present invention aid in the user's communicating its needs to others, which characteristic is absent in the Caustin invention.

Giaimo, U.S. Pat. No. 2,271,190 dated Jun. 8, 1940, is for illuminating the region where the cane is to be placed. The present invention can be differentiated from the Giaimo invention, since the present invention's lighted body is one integrated unit and emits light in all directions.

OBJECTS AND ADVANTAGES

Accordingly, besides the objects and advantages stated above, several objects and advantages of the present inventions are:

To provide for a device wherein its entire body is illuminated in color; in order for the sight-handicapped user to communicate their needs to others, and to make their presence known to sighted persons;

To provide for a device wherein the battery, switch, light bulb and conductive wires are housed within close proximity to one another, as one integrated, interchangeable, and disposable unit;

To provide for device which is easily separable into two pieces, in order for the light bulb and battery to be easily replaceable;

To provide for a device wherein said switch is easily recognizable to the sight handicapped user as "on" or "off";

To provide for a device which is made of shock proof, transparent or translucent acrylic material for strength and enhanced light emitting effect;

To provide for a device which cane be easily detached and attached to various types of canes by the sight handicapped user; and To provide for a device which is inexpensive to manufacturer. Still further objects and advantages will become apparent from a consideration of the ensuing description and drawings.

REFERENCE NUMBERS ON THE DRAWINGS

Figure 1:
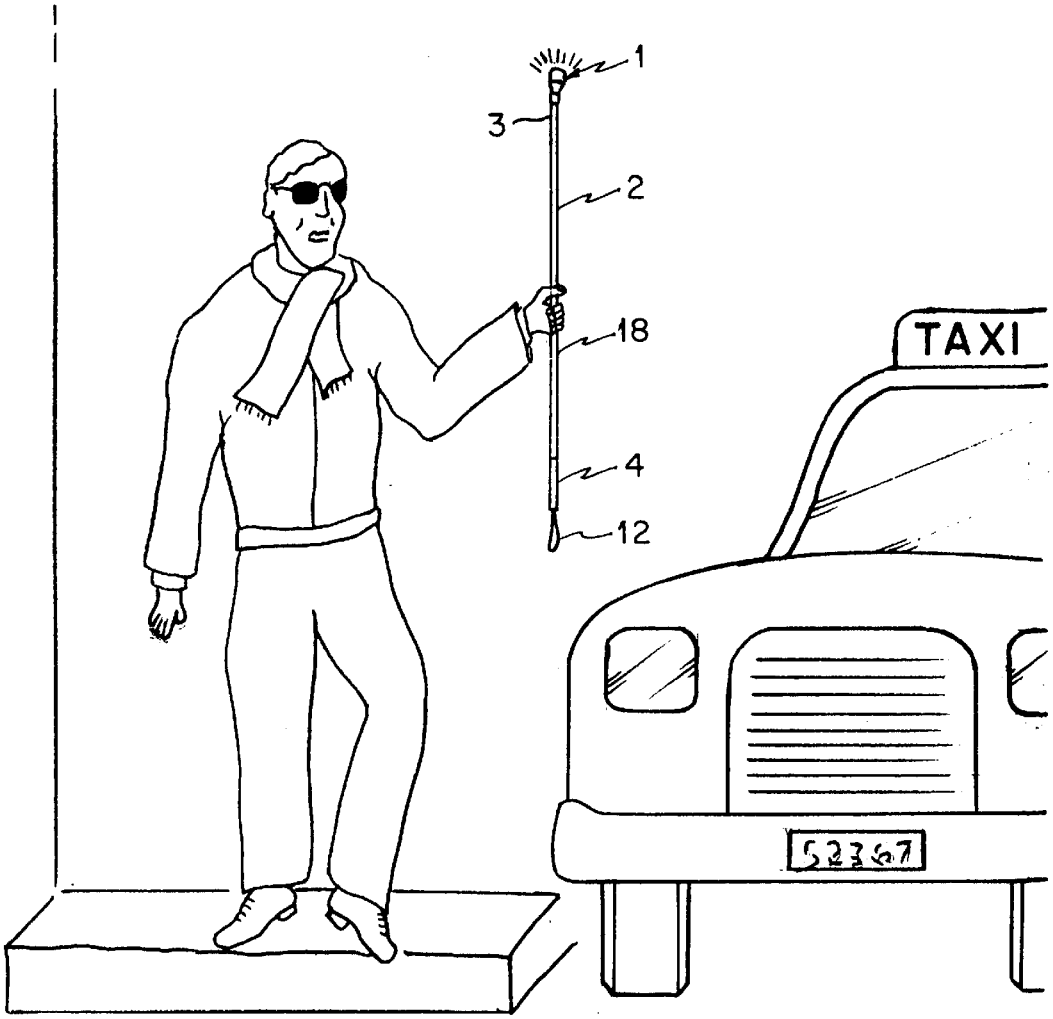
FIG. 1. is a perspective view of the present invention, attached to the ground end of a cane, (also showing the cord looped through the cane's handle), being used to hail a cab.

1 Invention
2 Cane
3 Ground end of cane
4 Handle end of cane
5 Neck portion of body portion
6 Body portion
7 Light bulb
8 Battery
9 Conductive wires
10 Switch
11 Threaded body edge
12 Cord
13 Eye member
14 Hollow pocket of body portion
15 Reflective flakes
16 Circuit means
17 Threaded cap edge
18 Cane shaft
19 Knot
20 Wall of body portion
21 Air bubbles
22 Shank portion of neck portion
23 Base portion of neck portion
24 Cap portion of body portion
25 Outer surface wall of body portion
26 Inner surface wall of hollow body portion
26' Inner surface wall of solid body portion
27 Stopper

SUMMARY OF THE INVENTION

This invention relates generally to cane tips for blind or sight-handicapped users; more particularly, to a lighted tip which aids the user to become more visible to sighted persons and communicates the user's needs to sighted persons. For example, when the invention is attached to the ground end of a cane, and emits a yellow light, (the standard color for taxi cab lights), the invention would aid the user in hailing a taxi cab. Other colors, such as red and white, may indicate to others that the user is a sight handicapped person.

Prior art devices disclose many canes, batons, and flashlights whereby an illuminating means is incorporated into the shaft of the devices. Also, the purpose of these prior art devices is to warn others of the user's presence in darkness, or to aid the user's sight while walking. The prior art devices are differentiated from the present invention, in that the prior art were not used to communicate the user's needs to others. The present invention's purpose is to aid the user in communicating that the user needs to hail a taxi-cab, requires attention, or is sight-handicapped.

Prior art inventions have the light switch in the handle portion. The batteries are usually housed, together with the light bulb, in the shaft portion, or near the ground end, away from the handle. The batteries and light bulb take up much space in the cane shaft, can be easily jarred loose during use, and are clumsy and heavy. The present invention is differentiated from the prior art in that the present invention is one integrated disposable compact unit. In the prior art, the user must purchase the entire cane in order to own a light emitting cane. In the present invention the user need only purchase the invention. The present invention can be attached to either hollow or solid constructed conventional canes. The invention is interchangeable and disposal; as it may be placed on various canes. Thus making the present invention a compact, lightweight, interchangeable, convenient, economical and useful device.

The preferred embodiment of the invention comprises body portion having a neck portion, (further comprising a shank and base portion), and a body portion (further comprising a cap portion), which are molded into one solid body. Acrylic material may be poured into a mold shaped like the invention, in order to create a solid disposable device. The invention's circuit means (battery, light bulb, switch and conductive wires), would be solidly encased in the molded acrylic. The switch would be embedded in the wall of body portion and exposed at the outer surface wall of body portion in order to be easily reachable and recognizable as either "on" or "off" by the blind or sight handicapped user (preferably a "push button" type switch). The solid "shock proof" structure would minimize the potential for the circuit means loosening, jarring or breaking during use. Also, the acrylic material would be of sufficient hardness in order to withstand normal wear.

Ground tips of the prior art are usually made of a conventional rubber material which do not emit light. The present invention's body (including cap), and neck (including shank and base) portions are composed of a transparent or translucent acrylic material which emits light in all directions. Reflective flakes or air bubbles may be dispersed throughout the acrylic material in order to enhance the light emitting qualities of the invention.

The invention is threadedly attached to a cane by a conventional cord which runs through the handle end of cane and length of the cane, and is then strung through an eye member in the shank portion of the neck portion of the invention. The cord is then pulled through the cane, looped through the handle, end of cane and tied into a knot at a location along the cane's shaft chosen by the user, in order to achieve proper cord tension. After the cord is tied, the invention is then slid into the hollow ground end, of cane with the base portion of neck portion being of predetermined diameter in order to securely fit the invention inside the cane. The invention can be easily be detached from a cane by untying the knotted cord and unthreading the cord through the eye member in the neck portion.

In an alternative embodiment of the invention, the invention's hollow cylindrically shaped neck portion may be slid over the ground end of cane. The hollow neck portion is of a predetermined diameter to tightly slide over the ground end of cane and secure the invention to the cane. In this slidable embodiment of the invention, the need for a threaded attachment is eliminated. The cane may be hollow or solid. If the cane is hollow, in order to preserve proper cord tension, the cord is threaded through a conventional stopper present in the ground end of the cane, pulled through the cane's shaft, looped through the handle, end of cane and knotted in a location in the cane's shaft chosen by the user. In this slidable alternative, the acrylic material may also contain reflective flakes or air bubbles to enhance the light emitting effect.

In a further alternate embodiment of the invention, its body portion (including its cap portion) may be hollow in order to house a circuit means comprised of a light bulb, battery, switch, and conducting wires. The switch may be embedded in the wall of body portion and exposed at the outer surface wall of body portion in order to be easily reachable, and for the user to easily recognize the switch as being in either the "on" or "off" position. A push button type switch is preferred for this purpose. In this embodiment, the body portion and cap portion of body portion may be threadedly separated from each other in order for the user to easily remove and replace the battery and light bulb. The wall and cap portions of body portion are of sufficient thickness in order to withstand normal wear.

The hollow embodiment of the invention may be adapted to both knotted and slidable attachments. Also, reflective flakes or air bubbles may be added to enhance both solid and hollow body portions light emitting effects.

DESCRIPTION OF THE PREFERRED EMBODIMENTS OF THE INVENTION

Referring to the drawings by numerals of reference, this invention relates generally to cane tips for blind or sight-handicapped users; more particularly, to a lighted cane tip which aids the user to become more visible to sighted persons and communicates the user's needs to sighted persons. For example, as shown in FIG. 1, when the invention 1 is attached to the ground end 3 of a cane 2, and emits a yellow light, the invention would aid the user in hailing a taxi cab. The user can attach the invention to the ground end 3 of the user's cane 2. A red or white light may indicate to other's that the user is a sight handicapped person.

Figure 2:
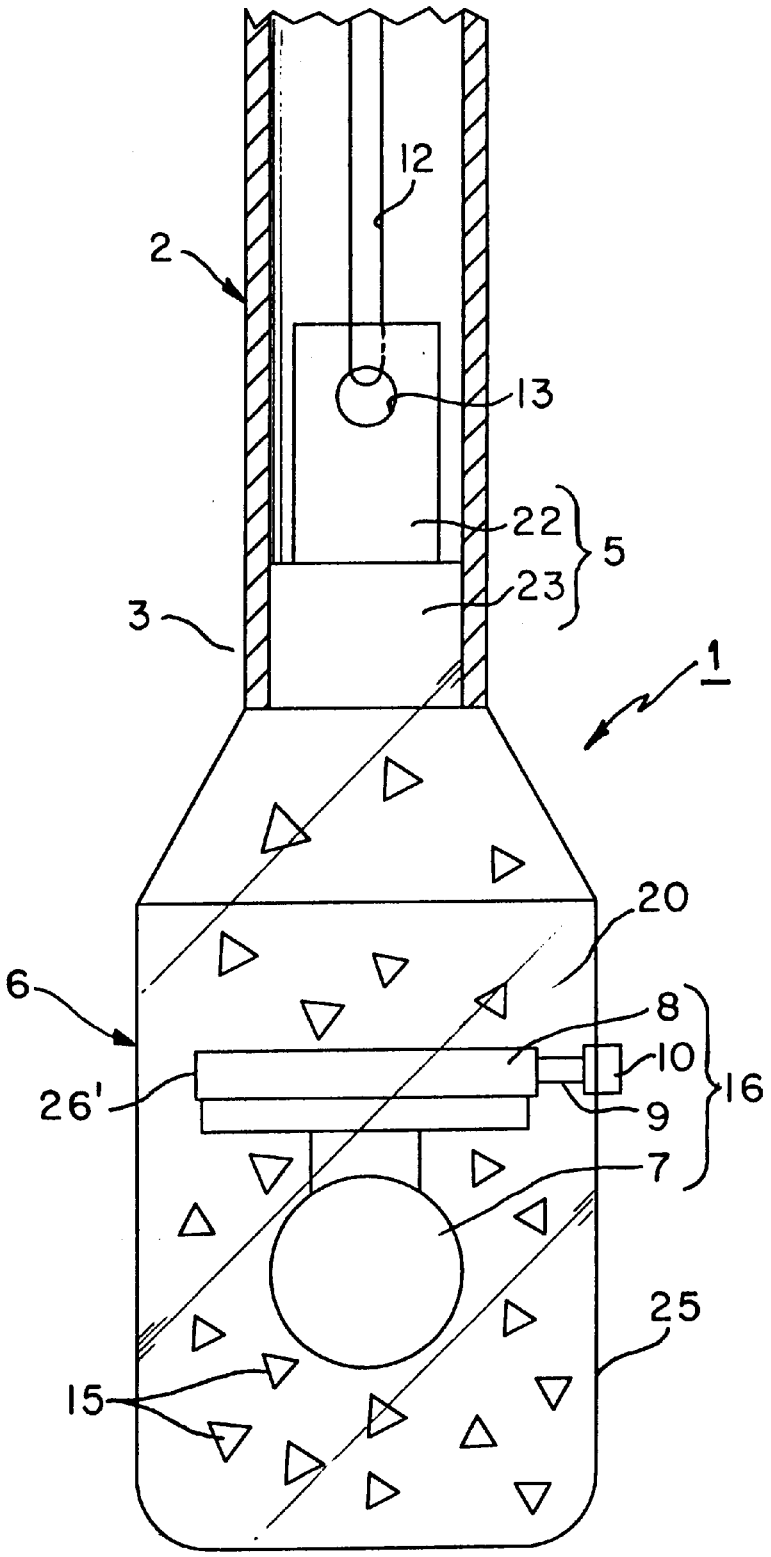
FIG. 2. is a longitudinal cross sectional view of the preferred embodiment of the present invention, with its neck portion knotted to a cane (shown in collapsed condition) to ensure proper cord tension, and further showing the light bulb, battery, switch, and conductive wires housed in the solid molded body portion, with reflective flakes enhancing the light emitting effect.

Prior art devices disclose many canes, batons, and flashlights for use by sighted as well as non-sighted users; whereby an illuminating circuitry means is incorporated into the body of the cane's shaft and handle. As shown in FIG. 2, the present invention is differentiated from the prior art in that the present invention's illuminating conventional circuit means 16 (comprised of a battery 8, light bulb 7, conductive wires 9, and switch 10), is one integrated compact unit. In the prior art, the user must purchase the entire cane in order to own a light emitting cane. In the present invention the user need only purchase the invention. The invention is interchangeable; as it may be placed on various canes, since most canes are of the same diameter, the only difference is the height of the cane. The invention comprises a neck portion 5, (further comprising shank 22 and base 23 portions), and a body portion 6. The elements of the invention's illuminating conventional circuit means 16, (battery 8, light bulb 7, switch 10, and conductive wires 9) may be molded into the invention, to form a solid structure which is encased by inner surface wall of solid body portion 26'. The switch 10 would be embedded in the wall of body portion 20, as well as exposed at the outer surface wall of body portion 25 of the invention, and would be of a type which would be easily recognizable as either an "on" or "off" by the blind or sight handicapped user (preferably a "push button" type switch). The solid structure would minimize the potential for the circuit means 16 loosening, jarring or breaking during use. Also, the acrylic material would be of sufficient "shock-resistance" and hardness in order to withstand normal wear. This embodiment of the invention would be disposal, as the battery 8 and light bulb 7 would not be changeable. Also, the ground tips of the prior art are made of the conventional opaque rubber. The neck portion 5, (further comprising shank 22 and base 23 portions) and body portion 6, are of made of transparent or translucent acrylic material which emits light. The acrylic material may have reflective flakes 15 or, as shown in FIG. 3, air bubbles 21, in order to enhance the light emitting affect.

The invention is knottedly attached to the cane by a conventional cord 12 which runs through the length of the cane 2, and is strung through an eye member 13 of the neck portion 5, and, as shown in FIG. 1, looped through the handle end of cane 4, and pulled through the cane's shaft 18, until it is knotted at a location chosen by the user. When the cord 12 is tied into a knot 19 (as shown in FIG. 3), the invention is attached to the ground end of cane 3 and proper cord tension is achieved.

After the cord 12 is so knotted, the invention's base portion 23, is slid into the hollow ground end of cane 3, with the base portion 23, having a predetermined diameter for tightly securing the invention's base portion 23 inside the ground end of cane 3. The invention can easily be detached from the cane 2 by untying the knot 19 and unthreading the cord 12 through the eye member 13.

Figure 3:
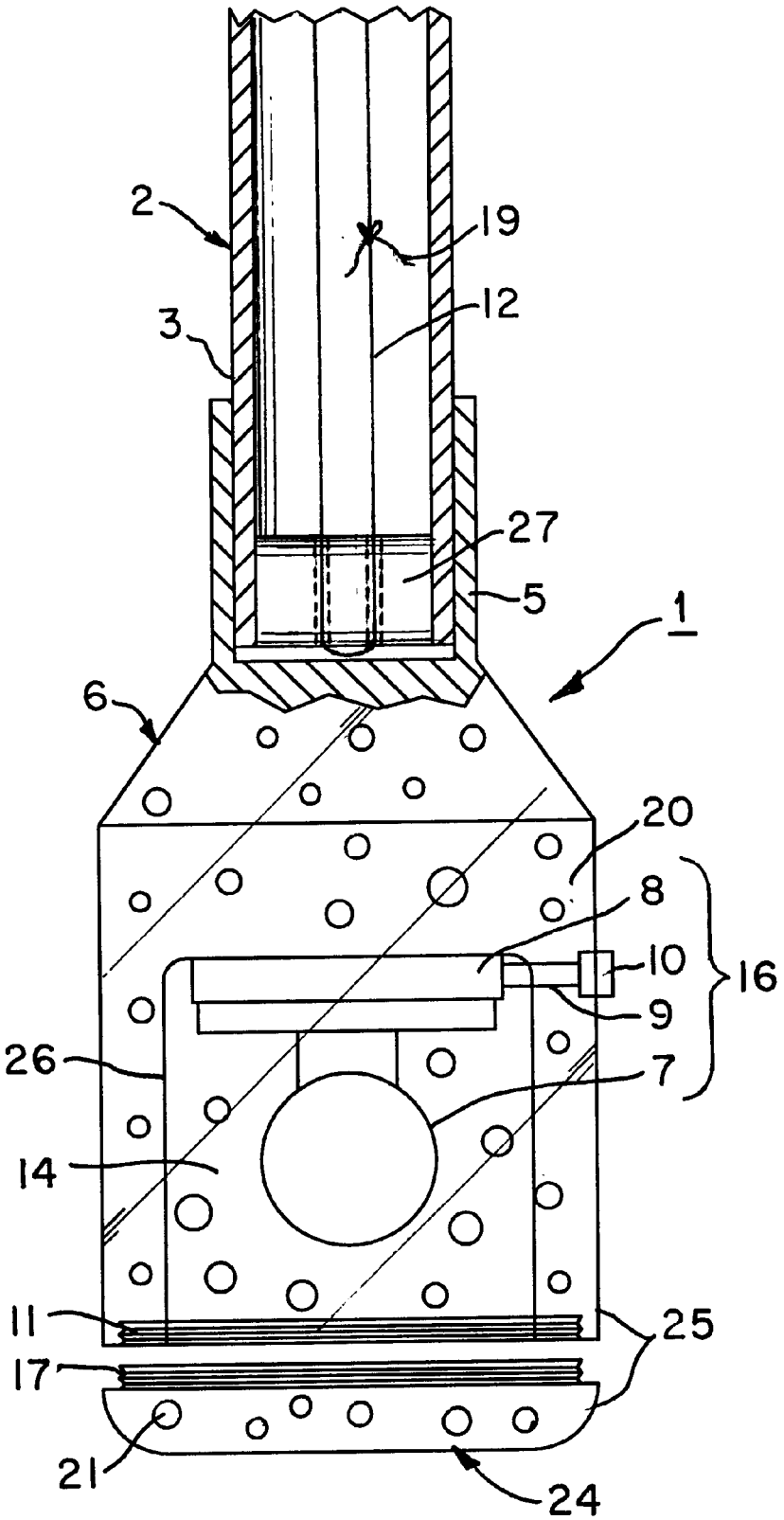
FIG. 3. is a longitudinal cross sectional view of an alternative embodiment of the present invention, slidably attached to a cane (shown in collapsed condition), with the invention's hollow neck securely slid over the cane; and the invention's cap portion rotatably unscrewed and separated from its hollow body into order for the battery and light bulb to be easily replaceable; and further showing the cane's cord threaded through a conventional stopper and knotted to ensure proper cord tension, with air bubbles enhancing the light emitting effect.

As shown in FIG. 3, in an alternative embodiment of the invention, the body portion 6 forms a hollow pocket 14, in order to house the light bulb 7, battery 8, switch 10, and conducting wires 9. The battery 8 would be removeably attached to the inner surface wall of hollow body portion 26 in order not to loosen during use. The switch 10 would be embedded in the wall of body portion 20 of the invention, exposed through outer surface wall of body portion 25, and would be of a type which would be easily recognizable as "on" or "off" by the blind or sight handicapped user (preferably a "push button" type switch). The wall of body portion 20, would be of predetermined thickness in order to its strength during normal wear. The acrylic material may contain small air bubbles 21, or, as shown in FIG. 2., reflective flakes 15, in order to enhance the invention's light emitting characteristics. The cap portion of body portion 24 may be separated from the body portion 6, by rotatably detaching threaded body edge 11 from threaded cap edge 17. Once cap portion of body portion 24 is so separated from the body portion 6, the user can easily replace the battery 8 and light bulb 7. The cap portion of body portion 24 my be attached to the body portion 6, by rotatably securing threaded body edge 11 to threaded cap edge 17. This embodiment of the invention may be slidably attached on the hollow ground end of cane 3, thus eliminating the need for tie attachment means. The neck portion 5, would be shaped like a hollow cylinder, and would be of predetermined diameter to securely fit over the ground end of cane 3. In order to preserve proper cord tension, a conventional stopper 27 is slid inside the ground end of cane 3. The cord 12 is threaded through the stopper 27, looped through the handle end of cane 4, and pulled through the cane's shaft 18, until it is knotted into a knot 19 at a location chosen by the user.

I claim:

1. An illuminated cane, to be used by sight handicapped persons, comprising:

an illuminated cane tip portion;

said illuminated cane tip portion having a body portion made of light emitting material;

said body portion having a body wall with inner and outer surface walls;

conventional circuit means housed inside said body wall;

said conventional circuit means having a battery, a light bulb and a switch connected by conducting wires;

said switch being embedded in said body wall and exposed through said outer surface wall;

a neck portion for attachment of said illuminated cane tip portion to said illuminated cane;

said illuminated cane tip portion being attached to the ground end of said illuminated cane;

said illuminated cane being of a hollow structure having a shaft portion and a handle portion;

said neck portion having a shank portion with an eye member;

said neck portion also having a base portion of a predetermined diameter approximately equal to the diameter of said illuminated cane;

a cord being threaded through said eye member, pulled through said shaft portion, looped through said handle portion, pulled through said shaft portion and knotted to ensure proper cord tension, to slidably hold said shank portion with said eye member of said neck portion of said illuminated cane tip portion inside said ground end of said illuminated cane, whereby, when said illuminated cane tip portion is attached to said ground end of said illuminated cane, and said switch is activated, light is emitted through said light emitting material which communicates said sight handicapped person's needs to others.

2. Illuminated cane, as claimed in claim 1, wherein said body portion further comprises said inner surface wall forming a hollow pocket which houses said conventional circuit means, wherein said battery and said light bulb are removably attached, and said body portion further comprises a threaded edge portion, and a threaded cap portion, wherein said threaded cap portion threadedly detaches from said threaded edge portion for removing and replacing said battery and said light bulb, and said base portion of said neck portion further comprises a hollow and cylindrical shape, for slidably securing said base portion of said neck portion of said illuminated cane tip portion over said ground end of said illuminated cane.

3. Illuminated cane, as claimed in claim 1, wherein said light bulb and said light emitting material are of various colors, and said light emitting material is comprised of acrylic material, which houses light enhancing materials or structures, such as reflective flakes or air bubbles, for withstanding normal wear and tear while enhancing the light emitting effect.

* * * * *